US005350655A

United States Patent [19]

Oshiba et al.

[11] Patent Number: 5,350,655

[45] Date of Patent: Sep. 27, 1994

[54] ELECTROPHOTOGRAPHIC PHOTORECEPTOR WITH TITANYL PHTHALOYCYANINE

[75] Inventors: Tomomi Oshiba, Hino; Fumitaka Mochizuki; Hajime Tadokoro, both of Hachioji; Akira Kinoshita; Kazumasa Watanabe, both of Hino; Kiyoshi Tamaki; Yoshihide Fujimaki, both of Hachioji, all of Japan

[73] Assignee: Konica Corporation, Tokyo, Japan

[21] Appl. No.: 28,385

[22] Filed: Mar. 9, 1993

[30] Foreign Application Priority Data

Mar. 13, 1992 [JP] Japan ..... 4-055247

[51] Int. Cl.[5] ..... G03G 5/06

[52] U.S. Cl. ..... 430/78; 430/83; 540/141

[58] Field of Search ..... 430/78, 83, 58; 540/141

[56] References Cited

U.S. PATENT DOCUMENTS

| | | | |
|---|---|---|---|
| Re. 30,772 | 10/1981 | Friedlander et al. | 525/421 |
| 5,213,929 | 5/1993 | Takano et al. | 430/78 |
| 5,252,417 | 10/1993 | Tokida et al. | 430/58 |

*Primary Examiner*—John Goodrow
*Attorney, Agent, or Firm*—Jordan B. Bierman

[57] ABSTRACT

An electrophotographic photoreceptor is disclosed. The photoreceptor comprises a conductive substrate and a photosensitive layer provided on the substrate. The photosensitive layer comprises titanylphthalocyanine having a peak at a Bragg angle $2\theta$ of $27.2° \pm 2°$ in the Cu-K$\alpha$ X ray-diffraction spectrum thereof and an alkyldiol which has 3 to 12 carbon atoms and the two hydroxyl group is bonded to carbon atoms arranged at different position in the molecular thereof. The amount of the diol is 0.1 to 1000 parts by weight per 100 parts by weight of the titanyl-phthalocyanine.

10 Claims, 5 Drawing Sheets

FIG. 1 (1)
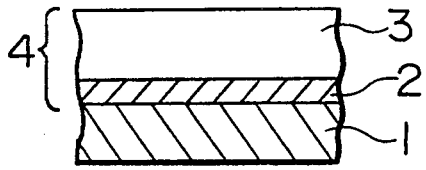
FIG. 1 (2)
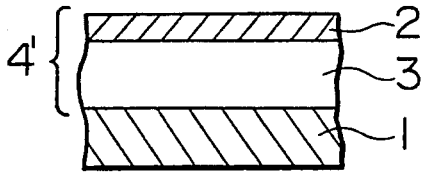
FIG. 1 (3)
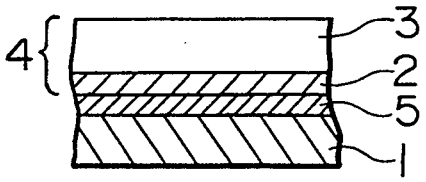
FIG. 1 (4)
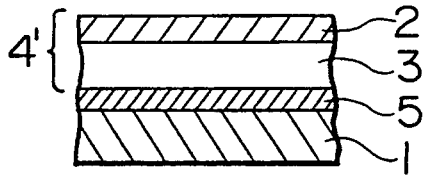
FIG. 1 (5)
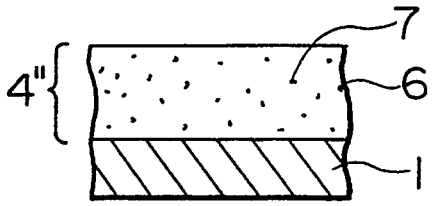
FIG. 1 (6)
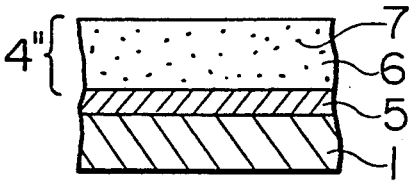

ELECTROPHOTOGRAPHIC PHOTORECEPTOR WITH TITANYL PHTHALOYCYANINE

FIELD OF THE INVENTION

The present invention relates to an electrophotographic photoreceptor, and especially to an electrophotographic photoreceptor using titanylphthalocyanine, having a specific crystal type, as a photoconductive material which is effective for use in printers and copiers and suitable for use with semiconductor laser light and LED light as the exposure means.

BACKGROUND OF THE INVENTION

Photoconductive material has been intensively researched in recent years, and applied to photoelectric sensing elements such as solar batteries and image sensors, as well as electrophotographic photoreceptors. Conventionally, an inorganic material has been chiefly used for these photoconductive materials. For instance, a photosensitive layer, the main ingredient of which is an inorganic light conductive material such as selenium, zinc oxide or cadmium sulfide, has been widely used in electrophotography.

However, such inorganic photoreceptors have insufficient photosensitivity, heat stability, water resistance and durability, which are required for electrophotographic photoreceptors. Since selenium, for instance, crystallizes by heat or touch by humans, its characteristics as a photoreceptor are easily deteriorated. An electrophotographic photoreceptor using cadmium sulfide is insufficient with regard to water resistance and durability, and zinc oxide is insufficient with regard to durability.

Since electrophotographic photoreceptors such as selenium and cadmium sulfide have toxicity, manufacturing and handling are largely restricted because of environmental problems, which have become serious in recent years.

Various organic photoconductive materials have therefore drawn attention, to overcome such defects of inorganic photoconductive materials, and are being actively researched for use as a photosensitive layer of an electrophotographic photoreceptor. For instance, Japanese Patented Publication No. 50-10496/1975 discloses an organic photoreceptor having a photosensitive layer comprising polyvinylcarbazole and trinitrofluorenone, but sensitivity and durability are still insufficient. Therefore, a functional separation type electrophotographic photoreceptor which allots a carrier generation function and a carrier transport function to different substances has been developed.

Since the material of such an electrophotographic photoreceptor can be selected from a wide range, it is easy to obtain arbitrary characteristics, and as a result, an organic photoreceptor with high sensitivity and high durability is possible.

Various organic compounds have been proposed as a carrier generation material and a carrier transport material for the functional separation type electrophotographic photoreceptor. Especially, the carrier generation material defines the basic characteristic of the photoreceptor. This carrier generation material employs photoconductive substances for practical use, including a polycyclic quinone compound such as dibromoanthanthron, a pyrylium compound and eutectic crystal complex of a pyrylium compound, squarilium compound, phthalocyanine compound and azo compound.

Titanylphthalocyanine having a specific crystal type is known as having excellent characteristics. Titanylphthalocyanine has many crystal types, and each crystal type shows quite different performance from others. Especially, the crystal type titanylphthalocyanine having the maximum peak is 27.2°±0.2° of the Bragg angle of $2\theta$ in the Cu-K$\alpha$ X-ray diffraction spectrum thereof, has remarkably high efficiency of photoelectrons, and an electrophotographic photoreceptor using this titanylphthalocyanine as a carrier generation material is extremely useful for the design of a high-speed printer, high-speed digital copier or high-speed facsimile.

The inventor has found that the efficiency of photoelectrons fell off when a Y-type titanylphthalocyanine having a significant peak at 27.3° and 9.6° in X-ray diffraction spectrum with extremely high efficiency of photoelectrons was heated or dehydrated in dry nitrogen. When Y-type crystals were put in the environment of normal temperature and normal humidity, they reabsorbed water, and the efficiency of photoelectrons recovered. That is, Y-type crystals are water-absorbing crystals, and the water molecules promoted dissociation of holes and electrons from excitons generated by light. It was considered that this was one of the reasons for high sensitivity. (Y. Fujimaki: IS&T's 7th International Congress on Advances in Nonimpact Printing Technologies, Paper Summaries, 269 (1991)). When such material is used as a carrier generation material, sensitivity characteristics due to the environment, especially humidity variation, may change causing problems in practical use.

On the other hand, to form a photosensitive layer, the titanylphthalocyanine to be used is finely dispersed in the organic solvent, adding binder polymers if necessary, and using various dispersion equipment, and the obtained dispersion is coated on the conductive substrate. Since the crystal stability of the compound having multi-form crystals varies depending on environmental conditions, the crystal is influenced by the solvent and binder, and the condition changes often in the dispersion. Since the titanylphthalocyanine crystals used in the present invention have especially high efficiency of photoelectrons, minor changes in crystallizing greatly influence the photoreceptor characteristics. Therefore, it is important to control changes in dispersion and to obtain long term crystal stability in the photosensitive layer against environmental factors.

SUMMARY OF THE INVENTION

The object of the present invention is to provide an electrophotographic photoreceptor with excellent sensitivity characteristics, useful for a high-speed printer, high-speed digital copier and high-speed facsimile.

The object of the present invention is also to provide an electrophotographic photoreceptor with little change of sensitivity characteristics caused by humidity variation.

A further object of the present invention is to obtain an electrophotographic photoreceptor having stable characteristics after repeated use.

Another object of the present invention is to obtain an electrophotographic photoreceptor with little variation of characteristics and excellent manufacturing stability.

The above objects of the invention are achieved by an electrophotographic photoreceptor comprising a conductive substrate and a photosensitive layer provided on the substrate. The photosensitive layer comprises a titanylphthalocyanine which has a maximum peak in the Cu-Kα X-ray diffraction spectrum thereof at a Bragg angle 2θ of 27.2°±0.2°, and an alkyldiol compound. The alkyldiol has 3 to 12 carbon atoms and two hydroxyl groups the diol are each bonded to different carbon atoms which is arranged at not adjacent positions from each other in the molecular of the alkyldiol. The adding amount of the alkyldiol is 0.1 to 1000 parts preferably 1 to 500 parts by weight per 100 parts by weight of the titanylphthalocyanine.

BRIEF DESCRIPTION OF THE DRAWINGS

FIGS. 1(1) to 1(6) are cross-sectional view of the photoreceptor of present invention.

DETAILED DESCRIPTION OF THE INVENTION

Figure 2:
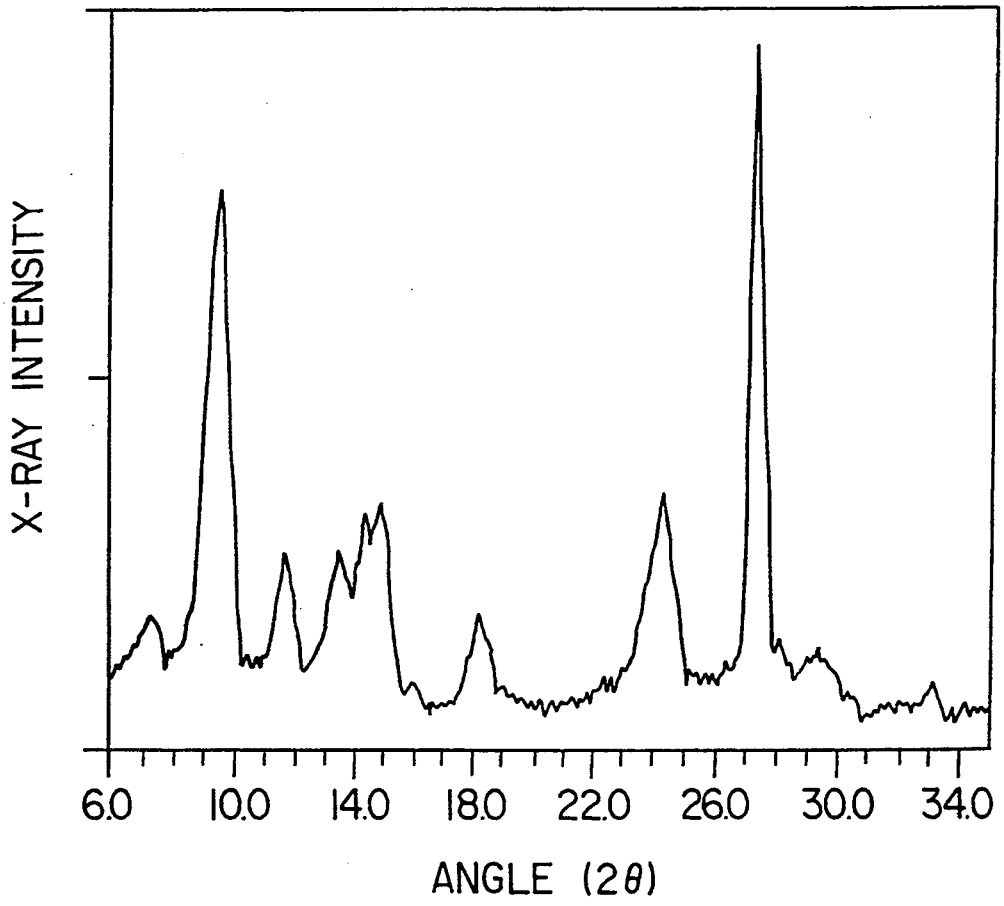
FIG. 2 is X-ray diffraction spectrum of titanylphthalocyanine used for the present invention.

As a result of study to improve environmental independence, especially stability against humidity, the inventors utilized a specific crystal type titanylphthalocyanine of the present invention as a carrier generation material. When this specific alkyldial was contained in the carrier generation layer, change of sensitivity characteristics by humidity variation was remarkably reduced. At the same time, the above-mentioned photoreceptor reduced changes in the electrification characteristics and sensitivity characteristics after repeated use.

Furtheremore stability of the titanylphthalocyanine specific crystal type was also improved remarkably by existing the above-mentioned specific alkyldial.

The chemical structure of the titanylphthalocyanine used for the present invention is represented by the following Formula I.

Formula I

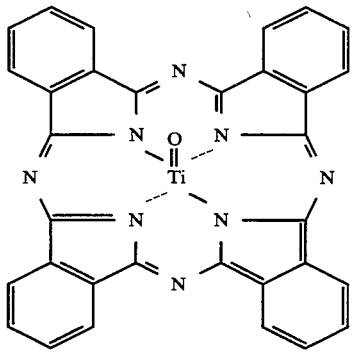

The X-ray diffraction spectrum is measured based on the following conditions. The peak here denotes a sharp plain protrusion, which is different from noise.

| | |
|---|---|
| X-ray tube | Cu |
| Voltage | 40.0 KV |
| Current | 100 MA |

-continued

| | |
|---|---|
| Start angle | 6.0 deg. |
| Stop angle | 35.0 deg. |
| Step angle | 0.02 deg. |
| Measuring time | 0.50 sec. |

Various methods can be used to synthesize the titanylphthalocyanine used in the present invention, and following reaction Formula 1 or 2 may be used.

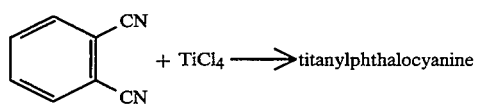

(1)

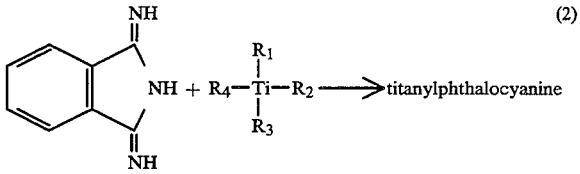

(2)

In the formula, R1 to R4 represent groups to be released after reaction.

The titanylphthalocyanine obtained as described above is processed as follows to be converted into the crystal type used in the present invention.

For instance, arbitrary titanylphthalocyanine of crystal type is dissolved concentrated sulfuric acid. The sulfuric acid solution is then poured into water to deposit crystals which are filtered, and thus the titanylphthalocyanine becomes amorphous.

Then this amorphous titanylphthalocyanine is processed by an organic solvent or by milling in the presence of water to form titanylphthalocyanine of the invention having a X-ray diffraction peaks at Bragg angle 2θ of 27.2°±0.2°.

Titanylphthalocyanine crystal having peaks at Bragg angle 2θ of 27.2°±0.2°, 24.1°±0.2° and 9.6°±0.2° in its X-ray diffraction spectrum can be obtained by processing the amorphous titanylphthalocyanine with an organic solvent in the presence of water. The organic solvent includes aromatic compounds such as orthodichlorobenzene and cyanobenzene, ketones such as cyclohexanone, cyclopentanone and methyl-isobutyl ketone, esters such as butyl acetate, hexyl acetate and butyl acrylate, and ethers such as tetrahydrofuran. Among thus titanylphthalocyanines, ones are particularly preferable which have a peak of heat adsorption at a temperature between 70° C. to 120° C. in the differential thermal analysis curve determined in the following condition.

Amount of sample: 10 mg

Environment: Ordinary atmosphere with 60% HR

Rising rate of temperature: 10° C. per minute

Titanylphthalocyanine having peaks of X-ray diffraction spectrum at Bragg angle 2θ of 27.2°±0.2°, 24.1°±0.2° and 9.0°±0.2° can be prepared by a method in which amorphous titanylphthalocyanine is heated in the presence of sulfonic acid with acetic acid as a catalyst and is hydrolyzed, as described in Japanese Patent L.O.P. No. 215867/1990. The titanylphthalocyanine also can be obtained by the method described in Japanese patent L.O.P. No. 128973/1991 in which amorphous titanylphthalocyanine is processed with an organic solvent such as n-octane with mechanical shearing after treatment by methanol. Among phthalocyanines thus obtained, ones are particularly preferable which have a heat adsorption peak at a temperature between 60° C. to 115° C. in the differential thermal analysis curve thereof.

Examples of synthesis of the titanylphthalocyanine are as follows.

SYNTHESIS EXAMPLE 1

In 200 ml of ortho-dichlorobenzene, 29.2 g of diiminoisoindoline was dispersed and 20.4 g of titanium tetrabutoxide was added to the dispersion. The dispersion was heated at 150°–160° C. for 5 hours in an atmosphere of nitrogen. After standing for cooling, precipitated crystals were filtered and washed with chloroform, 2% hydrochloric acid, water and methanol, in order to obtain titanylphthalocyanine. After drying, 26.2 g (yield 91.0%) of crude titanylphthalocyanine was obtained. Then 20.0 g of the crude phthalocyanine was dissolved in 200 ml of concentrated sulfuric acid by stirring for 1 hour at a temperature lower than 5° C., and the solution was poured into 4 litters of water at 20° C. Precipitated crystals were sufficiently washed with water, then 180 g of wet past of titanylphthalocyanine was obtained. Thus prepared titanylphthalocyanine was in an amorphous form having no apparent peak in the X-ray diffraction spectrum. To 60 ml of 3-pentanone and 20 ml of water, 40 g of the wet past containing 11% of solid was added and the mixture was stirred for 8 hours and stood for 1 day. To the viscous mixture thus obtained, 300 ml of isopropanol was added to precipitate crystals. The precipitate was filtered, washed with methanol and dried to obtain intentional crystals of titanylphthatocyanine. Thus obtained titanylphthalocyanine had peaks at Bragg angle $2\theta$ of 27.2°±0.2°, 24.1°±0.2° and 9.6°±0.2° in the X-ray diffraction spectrum as shown in FIG. 2, and had a heat adsorption peak at 98° C. in the differential thermal analysis curve.

SYNTHESIS EXAMPLE 2

Figure 5:
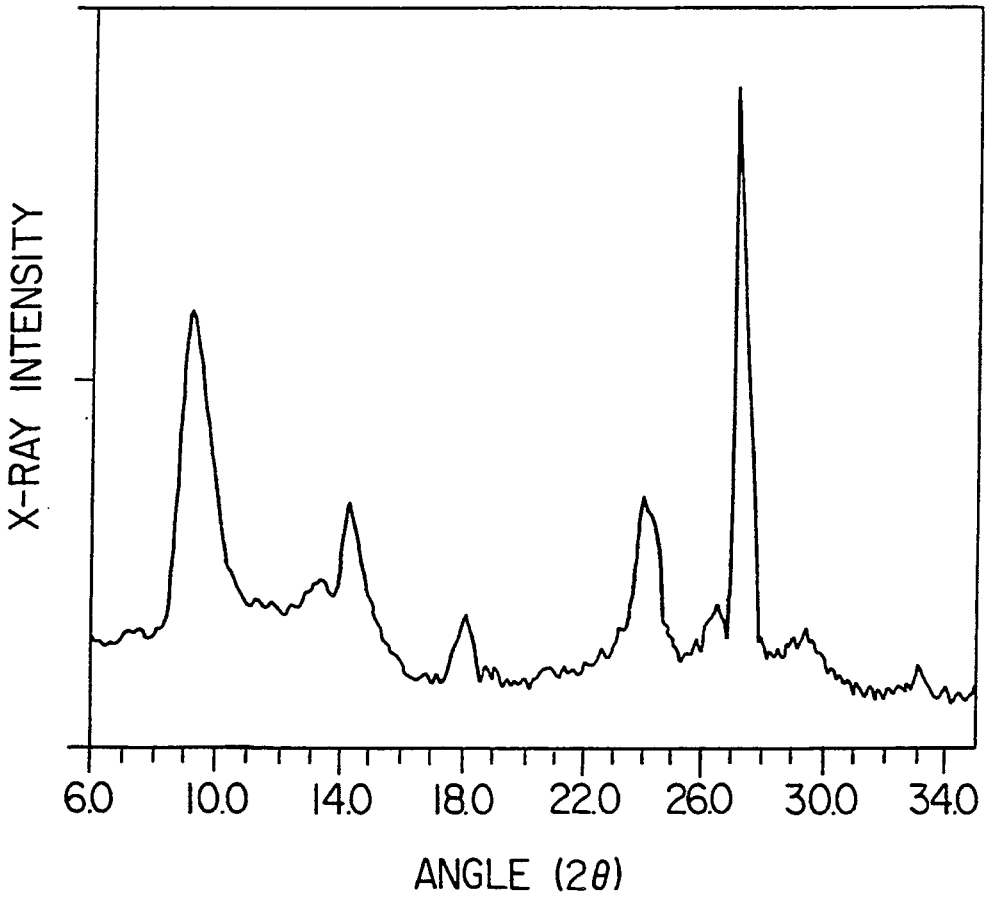
FIG. 5 is X-ray diffraction spectrum of titanylphthalocyanine used for Example 5.

A mixture of 100 ml of $\alpha$-chloronaphthalene, 7.5 g of ortho-phthalo-di-nitryl and 3.0 g of titanium tetrachloride was heated with stirring at 200° C. for 3 hours. The mixture was cooled by 50° C. so as to precipitate crystals. The precipitated crystals of dichlorotitaniumphthalocyanine was washed by dispersing in 100 ml of dimethylformamide and was stirred for 2 hours in hot water at 80° C. for hydrolysis. Thus crude titanylphthalocyanine was obtained. Five grams of the crude phthalocyanine was dissolve in 60 ml of concentrated sulfuric acid with cooling and the solution was poured into 2 liters of water to precipitate crystals. The precipitation was filtered to obtain amorphous titanylphthalocyanine. Four grams of the amorphous titanylphthalo-cyanine was stirred in 400 ml of methanol at room temperature for 8 hours. Treated crystals were separated from the mother liquid. The crystals were mixed with n-octane and were milled for 10 hours with glass beads. Thus intentional titanylphthalocyanine was obtained. Thus obtained titanylphthalocyanine had peaks at Bragg angle $2\theta$ of 27.2°±0.2°, 24.1°±0.2° and 9.0°±0.2° in the X-ray diffraction spectrum thereof as shown in FIG. 5, and had a peak at 68° C. in the differential thermal analysis curve thereof.

The effect of the present invention is enhanced when the alkyldiol compound used with these titanylphthalocyanines has 3 to 12 carbon atoms, and preferably 3 to 8 carbon atoms, and two hydroxyl groups bond to different carbon atoms in non-adjacent position.

Specific examples of such compounds include:

1,3-propanediol,
1,4-butanediol, 1,3-butanediol,
1,4-pentanediol, 1,5-pentanediol, 2,4-pentanediol, 2,2-dimethyl-1,3-propanediol,
1,5-hexanediol, 1,6-hexanediol, 2,5-hexanediol, 2-methyl-2,4-pentanediol, 2-ethyl-2-methyl-1,3-propanediol,
1,7-heptanediol, 2,2-dimethyl-1,3-propanediol, 2,4-dimethyl-2,4-pentanediol, 2-methyl-2-propyl-1,3-propanediol,
1,8-octanediol, 2,5-dimethyl-2,5-hexanediol, 2-ethyl-1,3-hexanediol, 2,2,4-trimethyl-1,3-pentanediol.

These alkyldiol compounds are used in an amount of 0.1 to 1000 parts by weight per 100 parts by weight of the titanylphthalocyanine.

The electrophotographic photoreceptor of the present invention can use not only the above-mentioned phthalocyanine, but also other photoconductive substances in combination, such as A, B, C, amorphous and the mixture of AB type titanytphthalocyanines, which are different crystal types from the titanylphthalocyanine of the present invention, other phthalocyanine compounds, naphthalocyanine compound, porphyrin derivative, azo compound, polycyclic quinone compound such as dibromoanthanthron, pyrylium compound, eutectic crystal complex of pyrylium compound and squarilium compound.

A carrier transport material can be used in combination in the electrophotographic photoreceptor of the present invention. Various kinds of carrier transport material can be used including compounds having nitrogen-containing heterocyclic nuclei and their condensed ring nuclei such as oxazole, oxadiazole, thiazole, thiadiazole and imidazole, including polyarylalkane compounds, pyrazoline compounds, hydrazone compounds, triarylamine compounds, styryl compounds, polys(-bis)styryl compounds, styryltriphenylamine compounds, $\beta$-phenylstyrylphenylamine compounds, butadiene compounds, hexatriene compounds, carbazole compounds and condensed polycyclic compounds. Specific examples of these carrier transport materials, including the one described in Japanese Patent L.O.P. No. 61-107356, are shown as follows.

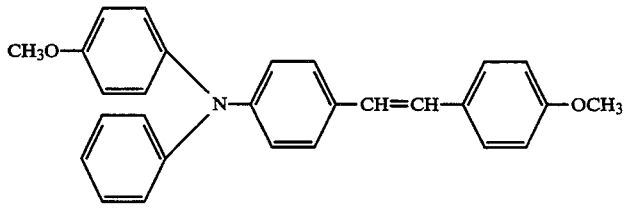

(1)

-continued
(2)
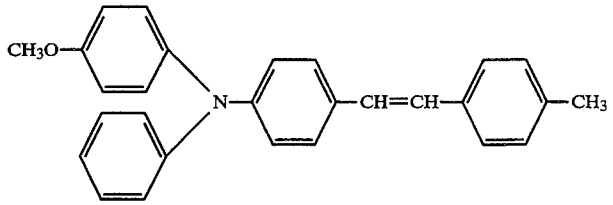
(3)
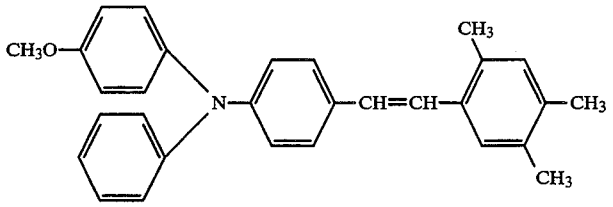
(4)
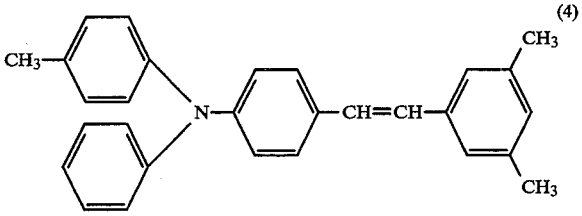
(5)
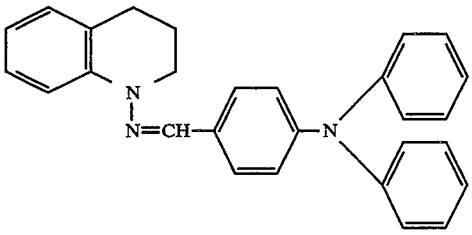
(6)
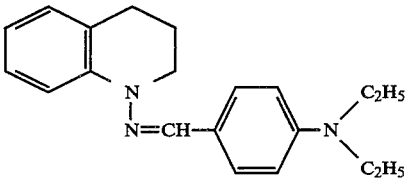
(7)
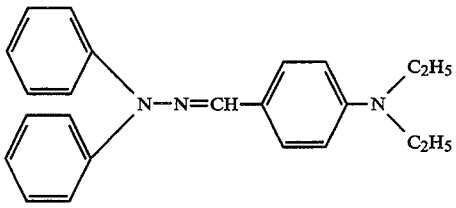
(8)
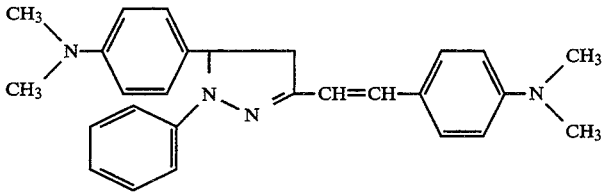
(9)
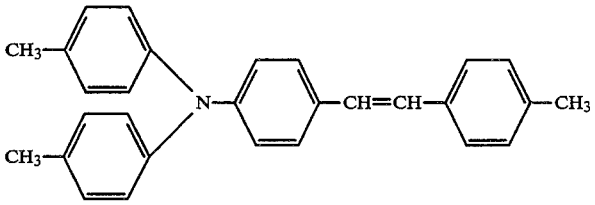
(10)
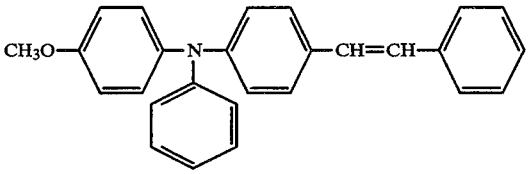
(11)
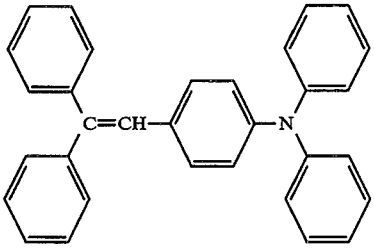

-continued
(12)
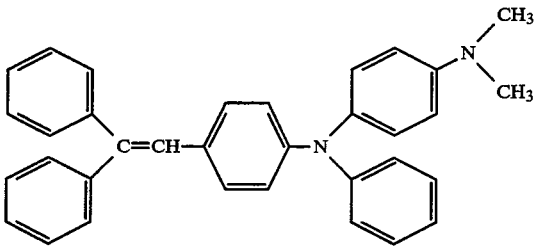
(13)
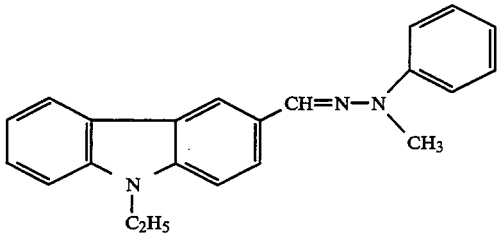
(14)
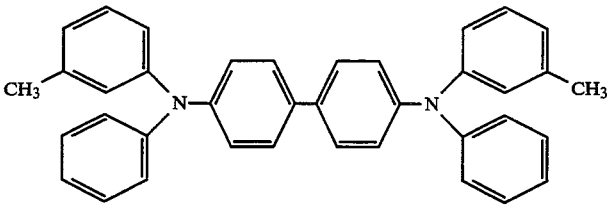
(15)
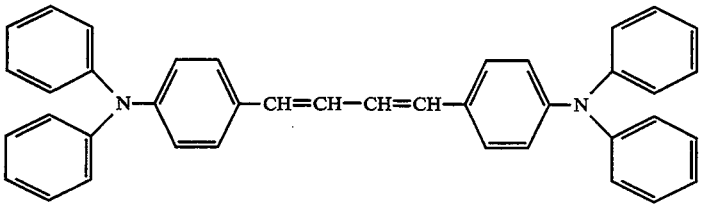
(16)
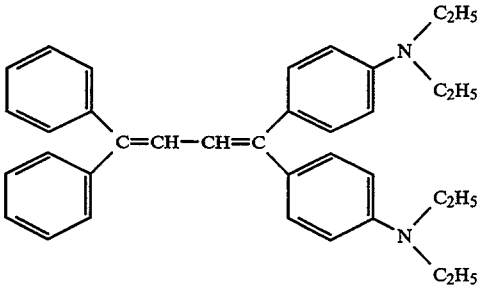
(17)
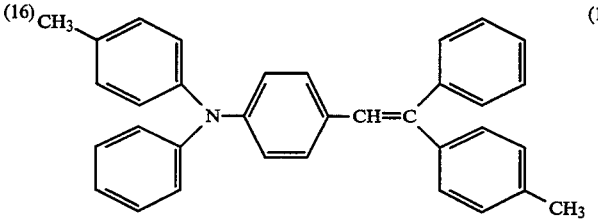
(18)
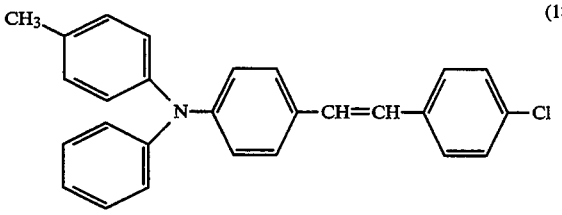
(19)
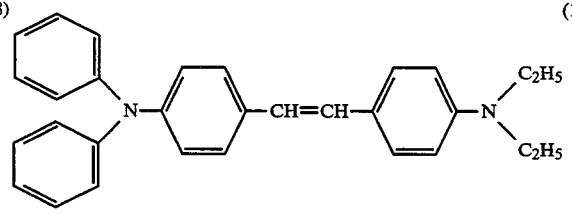
(20)
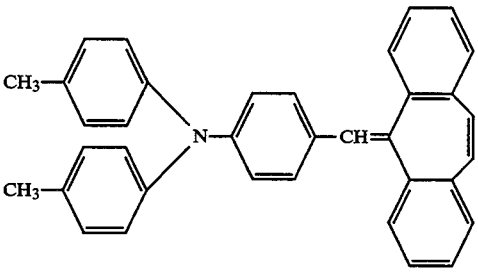

-continued (21)

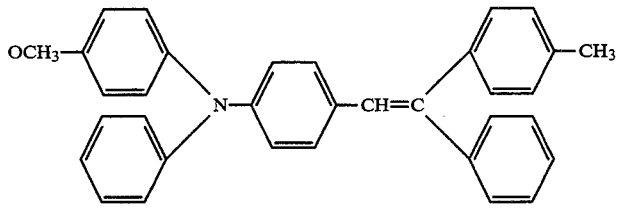

(22)

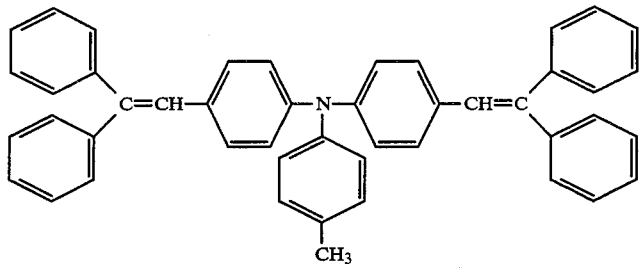

Various embodiments of the constitution of the photoreceptor are known, and the present invention can employ any one of them. A preferable embodiment is a function separation photoreceptor of multilayer type or dispersive type. In this case, it is usually constituted as shown by FIGS. 1(1) to (6). FIG. 1(1) shows a photosensitive layer 4, in which a carrier generation layer 2 and a carrier transport layer 3 are formed in that order on a conductive support 1. FIG. 1(2) shows a photosensitive layer 4', in which the carrier generation layer 2 and the carrier transport layer 3 of FIG. 1(1) are reversed in the order. FIG. 1(3) shows an interlayer 5 formed between photosensitive layer 4 and conductive support 1 of FIG. 1(1). FIG. 1(5) shows a photosensitive layer 4" which comprises a carrier generation material 6 and a carrier transport material 7 dispersed in the layer. FIG. 1(6) shows an interlayer 5 formed between photosensitive layer 4" and conductive support 1. A protective layer can be provided on the outermost layer in FIG. 1.

It is effective to coat a solution in which the carrier generation material or the carrier transport material are contained independently or in combination with binder and additives to form the photosensitive layer. Since the solubility of the carrier generation material is low in general, it is effective to disperse the carrier generation substance in the proper dispersion medium with dispersion equipment such as an ultrasonic homogenizer, ball mill, sandmill or homomixer. In this case, binder and additive are usually added in the dispersion.

Arbitrary solvent or dispersion medium may be chosen from a wide range to form the photosensitive layer, such as butylamine, ethylenediamine, N,N-dimethylformamide, acetone, methylethylketone, methylisopropylketon, methylisobutylketon, cyclohexanone, 4-methoxy-4-methyl-2-pentanone, tetrahydrofuran, dioxane, ethylacetate, butyl acetate, t-butyl acetate, methylcellosolve, ethylcellosolve, butylcellosolve, ethyleneglycoldimethylether, toluene, xylene, acetophenone, chloroform, dichloromethane, dichloroethane, trichloroethane, methanol, ethanol, propanol and butanol.

When the carrier generation layer or the carrier transport layer is formed, an arbitrary binder, preferably a hydrophobic high molecule polymer having film formation ability, can be used. Examples of such polymers are as follows, but they are not limited thereby. These binder resins may be used solely or in combination.

Polycarbonate

Polycarbonate Z resin, i.e., 4,4'-cyclohexylidene-bisphenol-based polycarbonate resin

| | |
|---|---|
| Acrylic resin | Methacryl resin |
| Polyvinyl chloride | Polyvinylidene chloride |
| Polystyrene | Styrene-butadiene copolymer |
| Polyvinyl acetate | Polyvinylformal |
| Polyvinyl butyral | Polyvinylacetal |
| Polyvinyl carbazole | Styrene-alkyd resin |
| Silicone resin | Silicone-alkyd resin |
| Silicone-butyral resin | Polyester |
| Polyurethane | Polyamide |
| Epoxy resin | Phenolic resin |

vinylidene chloride-acrylonitrile copolymer

Vinyl chloride-vinyl acetate copolymer

Vinyl chloride-vinyl acetate-maleic anhydride copolymer

In the above resins, polycarbonate Z resin, polyvinyl butyral, resin, silicone resin and silicone-butyral resin are preferably used as binder for the carrier generation layer. The rate of carrier generation material to binder is preferably between 10 and 600% by weight, and more preferably between 50 and 400% by weight. As binder for the carrier transport layer, polycarbonate resin and polycarbonate Z resin are preferably used. The rate of the carrier transport material to binder is preferably between 10 and 500% by weight. The thickness of the carrier generation layer is preferably 0.01 to 20 μm, and more preferably 0.05 to 5 μm. The thickness of the carrier transport layer is preferably 1 to 100 μm, and more preferably 5 to 30 μm.

The above-mentioned photosensitive layer can contain an electron acceptive substance to improve sensitivity, to decrease residual potential and to decrease fatigue after repeated use. Such electron acceptive substances includes succinic anhydride, maleic anhydride, dibromosuccinic anhydride, phthalic anhydride, tetrachlorophthalic anhydride, tetraboromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picrylchloride, quinonechloroimide, chlolanil, bromanil, dichlorodicyano-p-benzoquinone, anthraquinone, dinitroanthraquinone, 9-fluorenylidene maronontrile, polynitro-9-fluorenylidene maronontrile, picric acid, o-nitrobenzoic acid, p-nitrobenzoic acid, 3,5-dinitrobenzoic acid, pentafluorobenzoic acid, 5-nitro salicylic acid, 3,5-dinitrosalicylic acid, phthalic acid, mellitic acid and other compounds with high electron affinity. The addition rate of the electron acceptive substance is preferably 0.01 to 200, more preferably 0.1 to 100, per 100 weight of the carrier generation material.

A deterioration preventing agent such as antioxidant and light stabilizing agent can be contained in the above-mentioned photosensitive layer to improve storage stability, durability and environmental dependence. Effective compounds used for this include, for instance, chromanol derivatives such as tocopherol and its etherized or esterized compounds, polyarylalkane compounds, hydroquinone derivatives and its monoetherized and dietherized compounds, benzophenone derivatives, benztriazole derivatives, thioether compounds, phosphonic acid esters, phosphorous esters, phenylenediamine derivatives, phenol compounds, hindered phenol compounds, straight chain amine compounds, cyclic amine compounds and hindered amine compounds. Especially effective compounds include hindered phenol compounds such as "IRGANOX 1010" and "IRGANOX 565" (made by Ciba-Geigy Co. Ltd.,) "Sumilizer BHT" and "Sumilizer MDP" (made by Sumitomo Chemical Co., Ltd.,) hindered amine compounds such as "Sanol LS-2626" and "Sanol LS-622LD" (made by Sankyo company.)

The binders for the interlayer and protective layer include not only those used for the above-mentioned carrier generation layer and the carrier transport layer, but nylon resin, ethylene-vinyl acetate copolymer, ethylene-vinyl acetate-maleic anhydride copolymer ethylene type resin such as ethylene-vinyl acetate-methacrylate acid copolymer, polyvinyl alcohol and cellulose derivative. Thermosetting or chemical setting binders such as melamine resin, epoxy resin and isocyanate resin can also be used.

Material which may be used for the conductive support includes not only a metallic plate and a metallic drum, but conductive compounds such as conductive polymer and indium oxide, or metal thin layers such as aluminum and palladium provided on substrates such as paper and plastic films by means such as coating, deposition and laminating.

EXAMPLE

Example 1

Figure 3:
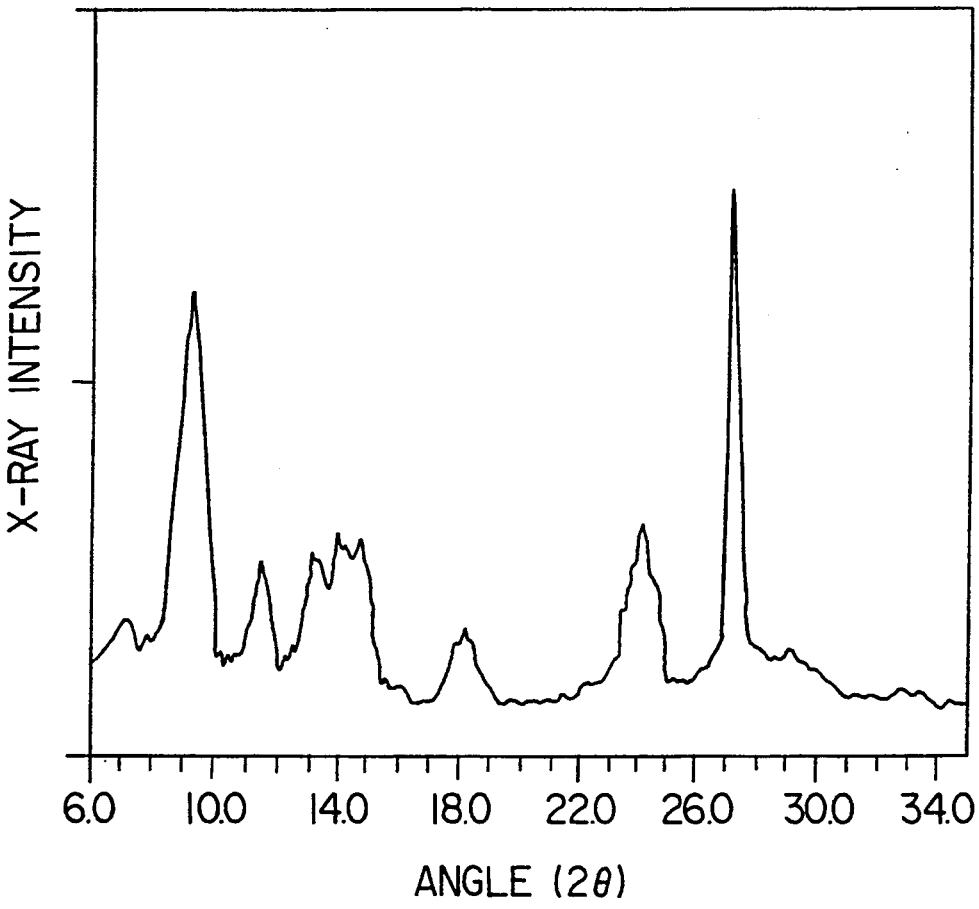
FIG. 3 is X-ray diffraction spectrum of titanylphthalocyanine obtained in Example 1.

100 parts by weight of methylethylketone and 0.5 parts by weight of 1,4-butanediol are added to 1 part by weight of titanylphthalocyanine powder obtained in synthesis example 1 having peaks in the X-ray diffraction spectrum at 27.2°, 24.1° and 9.5° of Bragg angle $2\theta$ and dispersed with a sandmill. After evaporation to dryness of a part of the obtained dispersant, the X-ray diffraction spectrum was measured; the result is shown in FIG. 3. On the other hand, after a 0.3 μm-thick subbing layer consisting of polyamide resin CM-8000 (made by Toray company) was provided on an aluminum-deposited polyester base by the wire bar coating method to prepare a substrate. The above obtained dispersion was coated by wire bar to form a carrier generation layer of 0.2 μm in thickness. Next, 1 part by weight of carrier transport material (21), 1.5 parts by weight of polycarbonate resin Iupilon Z-200 (made by Mitsubishi gas chemical Co. ltd.) and a small amount of silicone oil "KF-54" (made by The Shin-Etsu Chemical Co. Ltd.) are dissolved in 8 parts by weight of 1,2-dichloroethane, and the obtained solution was coated by braid coating on the carrer generation layer to form a carrier transport layer of 20 μm in thickness. Thus the photoreceptor of Example 1 was obtained.

Examples 2 to 4

The photoreceptors of Examples 2 to 4 of the present invention were obtained in the same manner as Example 1 except that 1,3-butanediol, 1,3-propanediol and 1,5-pentanediol were used in place of 1,4-butanediol. The X-ray diffraction spectrum measured after dispersing was the same as that of Example 1, and did not show any change of crystal form.

Comparative Example (1)

Figure 4:
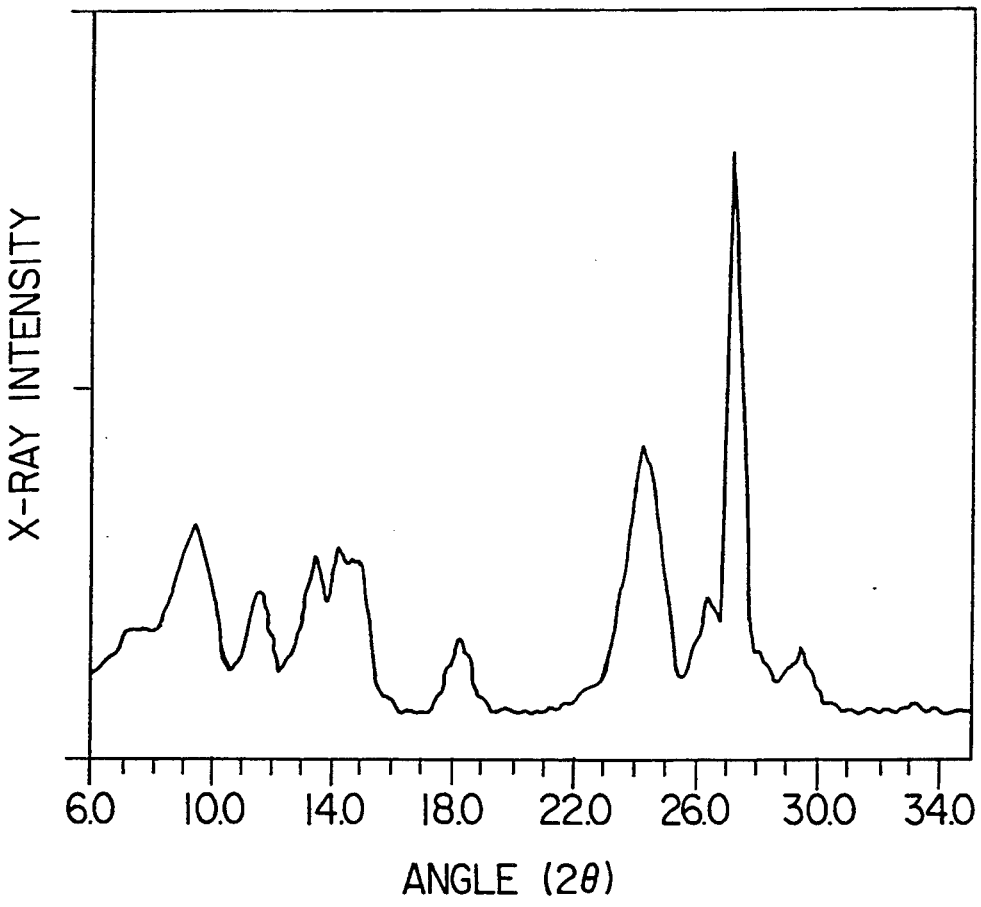
FIG. 4 is X-ray diffraction spectrum of titanylphthalocyanine obtained in Comparative example (1).

The photoreceptor of Comparative Example (1) was obtained in the same manner as Example 1 except that 1,4-butanediol was removed. The X-ray diffraction spectrum after evaporation to dryness of a part of obtained dispersant was shown in FIG. 4. There was a little peak at 26.2° of the Bragg angle of $2\theta$ which showed a change of crystal form.

Comparative Examples (2) to (8)

The photoreceptors of Comparative Examples (2) through (8) were obtained in the same manner as Example 1 except that 1-heptanol, 1-octanol, ethylene glycol, 1,2-butanediol, 1,2-hexanediol, glycerin and 1,16-hexadecanediol were used in place of 1,4-butanediol.

Comparative Example (9)

The photoreceptor of Comparative Example 9 was obtained in the same manner as Example 1 except that the amount of 1,4-butanediol was changed to 12 parts by weight.

Comparative Example (10)

The photoreceptor for Comparative Example 10 was obtained in the same manner as Example 1 except that the amount of 1,4-butanediol was changed to 0.0005 parts by weight.

Evaluation 1

The obtained Examples were installed in a copy machine of modified Konica 9028, made by Konica Corporation and using a semiconductor laser as a light source, under the conditions of 20° C. and 50% RH. Grid voltage $V_G$ was adjusted to 600 V. Then, potential $V_H$ of the unexposed area and potential $V_L$ of the area exposed with light irradiation with 0.7 mW were measured. The examples were moved into the environment of 10° C. and 20% RH, and $V_H$ and $V_L$ were measured by the same conditions. $V_H$ and $V_L$ after repeated use of 10,000 prints under the environment of 10° C. and 20% RH were also measured.

Evaluation 2

After the examples were left for a week under the conditions of 55° C. and 80% RH, they were installed in a modified Konica 9028 in the environment of 20° C. and 50% RH, and $V_H$ and $V_L$ were measured.

Example 5

The photoreceptor of Example 5 of the present invention was obtained in the same manner as Example 1 except that titanylphthalocyanine prepared in synthesis Example 2, which has peaks in the X-ray diffraction spectrum at 27.2°, 24.1° and 9.0° of the Bragg angle of $2\theta$, was used instead of the titanylphthalocyanine of Example 1.

Comparative Example (11)

The photoreceptor for Comparative Example (11) was obtained in the same manner as Example 5 except that the 1,4-butanediol was removed.

Example 5 and Comparative Example (11) were evaluated according to the methods of evaluation 1 and 2. The results are shown in Table 1.

TABLE 1

| | Determination condition | | | | | | | |
|---|---|---|---|---|---|---|---|---|
| | 20° C., 50% RH | | 10° C., 20% RH | | | | 20° C., 50% RH After storage at 55° C., 80% RH | |
| | Initial time | | Initial time | | After 10,000 | | | |
| | $V_H$(V) | $V_L$(V) | $V_H$(V) | $V_L$(V) | $V_H$(V) | $V_L$(V) | $V_H$(V) | $V_L$(V) |
| Example 1 | −596 | −40 | −601 | −49 | −600 | −51 | −595 | −42 |
| Example 2 | −593 | −43 | −600 | −53 | −582 | −52 | −593 | −45 |
| Example 3 | −592 | −43 | −601 | −51 | −578 | −53 | −595 | −48 |
| Example 4 | −595 | −41 | −599 | −47 | −595 | −50 | −597 | −43 |
| Example 5 | −589 | −69 | −602 | −75 | −600 | −78 | −589 | −71 |
| Comparative example 1 | −588 | −73 | −603 | −121 | −545 | −153 | −592 | −91 |
| Comparative example 2 | −559 | −69 | −591 | −108 | −550 | −150 | −548 | −85 |
| Comparative example 3 | −592 | −55 | −602 | −113 | −561 | −145 | −580 | −69 |
| Comparative example 4 | −585 | −72 | −593 | −99 | −563 | −138 | −579 | −88 |
| Comparative example 5 | −579 | −68 | −605 | −116 | −582 | −132 | −570 | −91 |
| Comparative example 6 | −582 | −78 | −591 | −119 | −572 | −159 | −575 | −95 |
| Comparative example 7 | −532 | −88 | −535 | −129 | −540 | −198 | −532 | −99 |
| Comparative example 8 | −583 | −82 | −579 | −109 | −545 | −190 | −553 | −89 |
| Comparative example 9 | −522 | −132 | −555 | −159 | −532 | −202 | −502 | −141 |
| Comparative example 10 | −586 | −74 | −602 | −119 | −539 | −160 | −591 | −95 |
| Comparative example 11 | −578 | −81 | −597 | −132 | −554 | −159 | −579 | −93 |

The results of the evaluation are shown in Table 1. As is shown in Table 1, sensitivity decreasing in the low humidity condition and raising in the $V_L$ value after repeating use are prevented by the addition of alkyldiols. It is also apparent that the alkyldiols are effective to stabilize the characteristics of photoreceptor from the results that sensitivity decreasing caused by standing in an atmosphere of 55° C. and 80% RH is little in each samples containing alkyldiol of the invention.

Example 6

To 1 part by weight of titanylphthalocyanine having peaks of X-ray diffraction spectrum at Bragg angle $2\theta$ of 27.2°, 24.1° and 9.5°, 100 parts by weight of methylethyl-ketone, 1 part by weight of polyvinylbutyral resin and 0.5 parts by weight of 1,4-butanediol were added. The mixture was dispersed by a sandmill. On the other hand, a polyester base on which an aluminum layer was deposited by evaporation were prepared. On the aluminum layer a subbing layer of polyamide resin CM-8000, product of Torey Co., having a thickness of 0.3 μm were provided. The above-obtained dispersion was coated on the subbing layer by a wire bar to form a carrier generation layer with a thickness of 0.2 μm. Then a solution prepared by dissolving 1 part by weight of carrier transfer substance (11), polycarbonate resin IUPILON Z-200 produced by Mitsubishi Gas Chemical Co. and a little amount of silicone oil KF-54 produced by Shin'etsu Kagaku Co. in 8 parts by weight of 1,8-dichloroethane was coated on the carrier generation layer by a blade coater to form a carrier transfer layer with a thickness of 20 μm. Thus obtained sample was referred as Sample 6.

Example 7

Sample 7 was prepared in the same manner as in Example 6 except that polyvinylbutyral resin was replaced by silicone resin.

Example 8

Sample 8 was prepared in the same manner as in Example 6 except that polyvinylbutyral resin was replaced by silicone-butyral resin.

Example 9

Sample 9 was prepared in the same manner as in Example 6 except that methylethylketone and polyvinylbutyral resin were replaced by cyclohexanone and polycarbonate Z resin, respectively.

Comparative example 12 to 15

Comparative sample 12 to 15 were prepared each the same as Sample 6 to 9, respectively, except that 1,4-butanediol was omitted.

Samples 6 to 9 and Comparative samples 12 to 15 were evaluated by the method of Evaluation 1 and Evaluation 2. Results of evaluation are shown in Table 2.

TABLE 2

| | Determination condition | | | | | | | |
|---|---|---|---|---|---|---|---|---|
| | 20° C., 50% RH | | 10° C., 20% RH | | | | 20° C., 50% RH After storage at 55° C., 80% RH | |
| | Initial time | | Initial time | | After 10,000 | | | |
| | $V_H$(V) | $V_L$(V) | $V_H$(V) | $V_L$(V) | $V_H$(V) | $V_L$(V) | $V_H$(V) | $V_L$(V) |
| Example 6 | −610 | −57 | −612 | −63 | −610 | −65 | −608 | −59 |
| Example 7 | −615 | −48 | −618 | −55 | −617 | −55 | −614 | −50 |
| Example 8 | −610 | −52 | −615 | −58 | −613 | −60 | −609 | −53 |
| Example 9 | −605 | −65 | −610 | −75 | −602 | −80 | −600 | −69 |
| Comparative example 12 | −605 | −78 | −610 | −125 | −555 | −159 | −573 | −89 |
| Comparative example 13 | −607 | −65 | −615 | −110 | −572 | −130 | −585 | −82 |
| Comparative example 14 | −603 | −68 | −612 | −113 | −567 | −132 | −582 | −85 |
| Comparative example 15 | −598 | −79 | −608 | −146 | −532 | −163 | −561 | −99 |

What is claimed is:

1. An electrophotographic photoreceptor comprising a conductive substrate having provided thereon a photosensitive layer, said photosensitive layer comprising;

a titanylphthalocyanine having a maximum peak, in the Cu-Kα X-ray diffraction spectrum thereof, at a Bragg angle 2θ of 27.2°±0.2°, an alkyldiol compound having 3 to 12 carbon atoms and 2 hydroxyl groups, each hydroxyl group being bonded to a different, non-adjacent carbon atom, said alkyldiol compound being present in an amount of 0.1 to 1000 parts per 100 parts by weight of said titanylphthalocyanine, and a binder resin selected from the group consisting of polycarbonate, polycarbonate Z, acrylic resin, methacrylic resin, polyvinyl chloride, polyvinylidene chloride, polystyrene, styrene-butadiene copolymer, polyvinyl acetate, polyvinylformal, polyvinylbutyral, polyvinylacetal, polyvinylcarbazole, styrene-alkyd resin, silicone resin, silicone-alkyd resin, silicone-butyral resin, polyester, polyurethane, polyamide, epoxy resin, phenolic resin, vinylidene chloride-acrylonitrile copolymer, vinyl chloride-vinyl acetate copolymer and vinyl chloride-vinyl acetate-maleic anhydride copolymer.

2. The photoreceptor of claim 1, wherein said titanylphthalocyanine is a crystal having peaks at Bragg angle 2θ of 27.2°±0.2°, 24.1°±0.2° and 9.5°±0.2° in the Cu-Kα X-ray diffraction spectrum thereof.

3. The photoreceptor of claim 2, wherein said titanylphthalocyanine is a crystal having peaks at Bragg angle 2θ of 27.2°±0.2°, 24.1°±0.2° and 9.5°±0.2° in the Cu-Kα X-ray diffraction spectrum has a heat adsorption paek between 70° C. to 120° C. in the differential thermal analysis curve thereof.

4. The photoreceptor of claim 1 wherein said titanylphthalocyanine is a crystal having peaks at Bragg angle 2θ of 27.2°±0.2°, 24.1°±0.2° and 9.0°±0.2° in the Cu-Kα X-ray diffraction spectrum thereof.

5. The photoreceptor of claim 4, wherein said titanylphthalocyanine is a crystal having peaks at Bragg angle 2θ of 27.2°±0.2°, 24.1°±0.2° and 9.0°±0.2° in the Cu-Kα X-ray diffraction spectrum has a heat adsorption paek between 60° C. to 115° C. in the differential thermal analysis curve thereof.

6. The photoreceptor of claim 1, wherein said diol has 3 to 8 carbon atoms.

7. The photoreceptor of claim 6, wherein said diol is 1,3-propanediol, 1,4-butanediol, 1,3-butanediol, 1,4-pentanediol, 1,5-pentanediol, 2,4-pentanediol, 2,2-dimethyl-1,3-propanediol, 1,5-hexanediol, 1,6-hexanediol, 2,5-hexanediol, 2-methyl-2,4-pentanediol, 2-ethyl-2-methyl-1,3-propanediol, 1,7-heptanediol, 2,2-dimethyl-1,3-propane- diol, 2,4-dimethyl-2,4-pentanediol, 2-methyl-2-propyl-1,3-propanediol, 1.8-octanediol, 2,5-dimethyl-2,5-hexanediol, 2-ethyl-1,3-hexanediol or 2,2,4-trimethyl-1,3-pentanediol.

8. The photoreceptor of claim 1, wherein the content of said alkyldiol compound is 1 to 500 parts per 100 parts of said titanylphthalocyanine by weight.

9. The photoreceptor of claim 1, wherein said photoreceptor comprises a carrier generation layer comprising said titanyl phthalocyanine, said alkyldiol compound and a binder, and a carrier transport layer comprising a carrier transport material.

10. The photoreceptor of claim 9, wherein said binder of said carrier generation layer is polycarbonate Z resin, polybutyl butyral, silicone resin or silicone-butyral resin.

* * * * *